US012017269B2

(12) United States Patent
Sunakawa et al.

(10) Patent No.: US 12,017,269 B2
(45) Date of Patent: Jun. 25, 2024

(54) METHOD FOR PRODUCING Fe-BASED NANOCRYSTALLINE ALLOY RIBBON, METHOD FOR PRODUCING MAGNETIC CORE, Fe-BASED NANOCRYSTALLINE ALLOY RIBBON, AND MAGNETIC CORE

(71) Applicant: PROTERIAL, LTD., Tokyo (JP)

(72) Inventors: Jun Sunakawa, Tokyo (JP); Nakao Moritsugu, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 587 days.

(21) Appl. No.: 17/275,192

(22) PCT Filed: Sep. 24, 2019

(86) PCT No.: PCT/JP2019/037220
§ 371 (c)(1),
(2) Date: Mar. 11, 2021

(87) PCT Pub. No.: WO2020/066989
PCT Pub. Date: Apr. 2, 2020

(65) Prior Publication Data

US 2022/0055099 A1 Feb. 24, 2022

(30) Foreign Application Priority Data

Sep. 26, 2018 (JP) ..... 2018-180031

(51) Int. Cl.
*B22D 11/06* (2006.01)
*C21D 9/00* (2006.01)
*C22C 45/00* (2023.01)

(52) U.S. Cl.
CPC ..... *B22D 11/0611* (2013.01); *B22D 11/0622* (2013.01); *B22D 11/0651* (2013.01);
(Continued)

(58) Field of Classification Search
CPC ..... B22D 11/0611; B22D 11/0651; B22D 11/0622
See application file for complete search history.

(56) References Cited

U.S. PATENT DOCUMENTS 5,069,731 A 12/1991 Yoshizawa et al.
6,425,960 B1 7/2002 Yoshizawa et al.
(Continued)

FOREIGN PATENT DOCUMENTS

EP 0640419 A1 * 3/1995 ..... B22D 11/0611
EP 3109872 A1 12/2016
(Continued)

OTHER PUBLICATIONS

JPO machine translation of JP 57-139453 (Year: 1982).*
(Continued)

*Primary Examiner* — Kevin E Yoon
(74) *Attorney, Agent, or Firm* — SOLARIS Intellectual Property Group, PLLC

(57) ABSTRACT

A method for producing an Fe-based nanocrystalline alloy ribbon, the method including a step of supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and a step of heat-treating the Fe-based amorphous alloy ribbon, thereby obtaining an Fe-based nanocrystalline alloy ribbon; wherein an outer peripheral part of the chill roll is composed of a Cu alloy, and a thermal conductivity of the outer peripheral part is from 70 W/(m·K) to 225 W/(m·K).

2 Claims, 2 Drawing Sheets

(52) U.S. Cl.
CPC ..... *B22D 11/0682* (2013.01); *C21D 9/0068* (2013.01); *C22C 45/008* (2013.01)

(56) References Cited

U.S. PATENT DOCUMENTS

| | | | | |
|---|---|---|---|---|
| 2003/0041931 | A1 | 3/2003 | Sunakawa et al. | |
| 2004/0043246 | A1* | 3/2004 | Myojin ..... | B22D 11/0651 148/435 |
| 2016/0035474 | A1* | 2/2016 | Azuma ..... | B23K 26/0622 29/605 |
| 2016/0360604 | A1 | 12/2016 | Moritsugu et al. | |

FOREIGN PATENT DOCUMENTS

| | | | | |
|---|---|---|---|---|
| JP | S57-139453 | A | 8/1982 | |
| JP | H01-242757 | A | 9/1989 | |
| JP | H04-4393 | B2 | 1/1992 | |
| JP | 2001-001113 | A | 1/2001 | |
| JP | 2002-316243 | A | 10/2002 | |
| JP | 2006-281317 | A | 10/2006 | |
| JP | 2007-007714 | A | 1/2007 | |
| JP | 2015-167228 | A | 9/2015 | |
| WO | WO-2007077651 | A1 * | 7/2007 | ..... B22D 11/0611 |

OTHER PUBLICATIONS

English language translation of the following: Office action dated May 10, 2022 from the JPO in a Japanese patent application No. 2020-549202 corresponding to the instant patent application.

English language translation of the following: Decision of Refusal dated Oct. 18, 2022 from the JPO in a Japanese patent application No. 2020-549202 corresponding to the instant patent application.

International Search Report issued in International Application No. PCT/JP2019/037220 on Dec. 17, 2019.

Extended European Search Report dated Mar. 25, 2022, issued in corresponding EP Patent Application No. 19864572.3.

* cited by examiner

METHOD FOR PRODUCING Fe-BASED NANOCRYSTALLINE ALLOY RIBBON, METHOD FOR PRODUCING MAGNETIC CORE, Fe-BASED NANOCRYSTALLINE ALLOY RIBBON, AND MAGNETIC CORE

TECHNICAL FIELD

The present disclosure relates to a method for producing an Fe-based nanocrystalline alloy ribbon, a method for producing a magnetic core, an Fe-based nanocrystalline alloy ribbon, and a magnetic core.

BACKGROUND ART

Fe-based nanocrystalline alloys have excellent magnetic properties such as low loss and high magnetic permeability, and therefore, they are used as materials for magnetic parts (for example, magnetic cores).

A magnetic core including an Fe-based nanocrystalline alloy ribbon is produced, for example, by rapidly solidifying a molten Fe-based alloy according to a single roll method to obtain an Fe-based amorphous alloy ribbon and, after winding or layering, heat-treating the obtained Fe-based amorphous alloy ribbon, whereby nanocrystal particles are precipitated in the alloy structure of the Fe-based amorphous alloy ribbon and the Fe-based amorphous alloy ribbon is converted into an Fe-based nanocrystalline alloy ribbon (see, for example, Patent Document 1).

Regarding a magnetic core including an Fe-based nanocrystalline alloy ribbon, Patent Document 2 discloses, for example, as a low loss-magnetic core for a high frequency acceleration cavity to be used as a magnetic core for a high frequency acceleration cavity, a magnetic core for a high frequency acceleration cavity, the magnetic core having a configuration in which an Fe-based nanocrystalline alloy ribbon having a roll contact surface and a free surface according to a single roll method is wound via an insulation layer, wherein protrusions having a specified form are dispersed on the free surface of the Fe-based nanocrystalline alloy ribbon, and moreover, the protrusions are characterized in that the tops thereof are polished to make them blunt.

Patent Document 1: Japanese Patent Publication (JP-B) No. H4-4393

Patent Document 2: Japanese Patent Application Laid-Open (JP-A) No. 2015-167228

SUMMARY OF INVENTION

Technical Problem

In Patent Document 2, the following problem is described. Namely, in a case in which the thickness of a conventional alloy ribbon, which has a thickness of more than 15 μm, is reduced, a protrusion exists on one of the main surfaces of the alloy ribbon, and an insulation layer is not formed at the part of this protrusion. As a result, in the magnetic core, contact and conduction occur between alloy ribbon that is adjacent to itself via the insulation layer, and thus there is a problem that the insulation properties deteriorate. Patent Document 2 describes that this problem can be addressed by polishing the top of the protrusion to make it blunt.

However, the method of polishing the top of the protrusion to make it blunt, which is described in Patent Document 2, is problematic in that the production man-hours are increased. Further, there is a further problem in that the maintenance management man-hours for the polishing capability are significant. Moreover, it is difficult to perform effective polishing of the kind described above, over almost the entire surface of the Fe-based nanocrystalline alloy ribbon, continuously, without any unevenness. Therefore, efforts to ensure a high insulation property, continuously and stably, are thus restricted.

Accordingly, as a technique for alleviating protrusions in an Fe-based nanocrystalline alloy ribbon having a reduced thickness (specifically, the thickness is 15 μm or less), a technique of suppressing the occurrence of protrusions itself is required, without relying on the technique of polishing the tops of the protrusions.

An object of the first aspect of the present disclosure is to provide a method for producing an Fe-based nanocrystalline alloy ribbon, the method being capable of producing an Fe-based nanocrystalline alloy ribbon having a reduced thickness, in which the occurrence of protrusions in the free solidified surface is suppressed.

An object of the second aspect of the present disclosure is to provide a method for producing a magnetic core, the method being capable of producing a magnetic core including a wound body in which an Fe-based nanocrystalline alloy ribbon having a reduced thickness is wound via an insulation layer, the magnetic core having excellent insulation properties between the Fe-based nanocrystalline alloy ribbon that is adjacent to itself via the insulation layer.

An object of the third aspect of the present disclosure is to provide an Fe-based nanocrystalline alloy ribbon having a reduced thickness, in which the occurrence of protrusions in the free solidified surface is suppressed.

An object of the fourth aspect of the present disclosure is to provide a magnetic core including a wound body in which an Fe-based nanocrystalline alloy ribbon having a reduced thickness is wound via an insulation layer, the magnetic core having excellent insulation properties between the Fe-based nanocrystalline alloy ribbon that is adjacent to itself via the insulation layer.

Solution to Problem

Specific means for addressing the foregoing problems are as follows.

<1> A method for producing an Fe-based nanocrystalline alloy ribbon, the method including:

a step of supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm; and a step of heat-treating the Fe-based amorphous alloy ribbon, thereby obtaining an Fe-based nanocrystalline alloy ribbon;

wherein the outer peripheral part of the chill roll includes a Cu alloy, and the thermal conductivity of the outer peripheral part is from 70 W/(m·K) to 225 W/(m·K).

<2> The method for producing an Fe-based nanocrystalline alloy ribbon according to <1>, wherein the Vickers hardness of the outer peripheral part is 250 HV or more.

<3> The method for producing an Fe-based nanocrystalline alloy ribbon according to <1> or <2>, wherein the molten Fe-based alloy has an alloy composition represented by the following Composition Formula (A):

$$Fe_{100-a-b-c-d-e}Cu_aSi_bB_cNb_dC_e \quad \text{Composition Formula (A):}$$

wherein, in Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

<4> A method for producing a magnetic core including a wound body C in which an Fe-based nanocrystalline alloy ribbon is wound via an insulation layer, the method including:

a step of supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm;

a step of forming the insulation layer on the free solidified surface of the Fe-based amorphous alloy ribbon:

a step of winding the Fe-based amorphous alloy ribbon having the insulation layer formed thereon, thereby obtaining a wound body A in which the Fe-based amorphous alloy ribbon is wound via the insulation layer; and a step of heat-treating the wound body A, thereby obtaining the wound body C;

wherein the outer peripheral part of the chill roll includes a Cu alloy, and the thermal conductivity of the outer peripheral part is from 70 W/(m·K) to 225 W/(m·K).

<5> The method for producing a magnetic core according to <4>, wherein the Vickers hardness of the outer peripheral part is 250 HV or more.

<6> The method for producing a magnetic core according to <4> or <5>, wherein the molten Fe-based alloy has an alloy composition represented by the following Composition Formula (A):

$$Fe_{100-a-b-c-d-e}Cu_aSi_bB_cNb_dC_e \qquad \text{Composition Formula (A):}$$

wherein, in Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

<7> An Fe-based nanocrystalline alloy ribbon, including:

a free solidified surface; and a roll contact surface, wherein:

a number of protrusions P in the free solidified surface, each having a depression at a central part thereof, is 1.2 or less per 100 $mm^2$ of area, a width of the ribbon is from 5 mm to 65 mm, and a thickness of the ribbon is from 10 μm to 15 μm.

<8> The Fe-based nanocrystalline alloy ribbon according to <7>, wherein the warpage in the width direction is 0.30 mm or less per 10 mm of width.

<9> The Fe-based nanocrystalline alloy ribbon according to <7> or <8>, having an alloy composition represented by the following Composition Formula (A):

$$Fe_{100-a-b-c-d-e}Cu_aSi_bB_cNb_dC_e \qquad \text{Composition Formula (A):}$$

wherein, in Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

<10> A magnetic core including a wound body C1, including the Fe-based nanocrystalline alloy ribbon according to any one of <7> to <9>, which is wound via an insulation layer.

<11> The magnetic core according to <10>, wherein the insulation rate RI represented by the following Equation (1) is 80% or higher:

$$RI = Rr/(Ru \cdot Lr) \times 100(\%) \qquad \text{Equation (1):}$$

wherein, in Equation (1):

Rr represents the direct current electric resistance value (Ω) between one end of the innermost periphery, and another end of the outermost periphery, of the Fe-based nanocrystalline alloy ribbon, Ru represents the direct current electric resistance value (Ω) per 1 m of length in the longitudinal direction of the Fe-based nanocrystalline alloy ribbon, and Lr represents the length (m) in the longitudinal direction of the Fe-based nanocrystalline alloy ribbon.

Advantageous Effects of Invention

According to the first aspect of the present disclosure, a method for producing an Fe-based nanocrystalline alloy ribbon, the method being capable of producing an Fe-based nanocrystalline alloy ribbon having a reduced thickness, in which the occurrence of protrusions in the free solidified surface is suppressed, may be provided.

According to the second aspect of the present disclosure, a method for producing a magnetic core, the method being capable of producing a magnetic core including a wound body in which an Fe-based nanocrystalline alloy ribbon having a reduced thickness is wound via an insulation layer, the magnetic core having excellent insulation properties between the Fe-based nanocrystalline alloy ribbon that is adjacent to itself via the insulation layer, may be provided.

According to the third aspect of the present disclosure, an Fe-based nanocrystalline alloy ribbon having a reduced thickness, in which the occurrence of protrusions in the free solidified surface is suppressed, may be provided.

According to the fourth aspect of the present disclosure, a magnetic core including a wound body in which an Fe-based nanocrystalline alloy ribbon having a reduced thickness is wound via an insulation layer, the magnetic core having excellent insulation properties between the Fe-based nanocrystalline alloy ribbon that is adjacent to itself via the insulation layer, may be provided.

DESCRIPTION OF EMBODIMENTS

Figure 1:
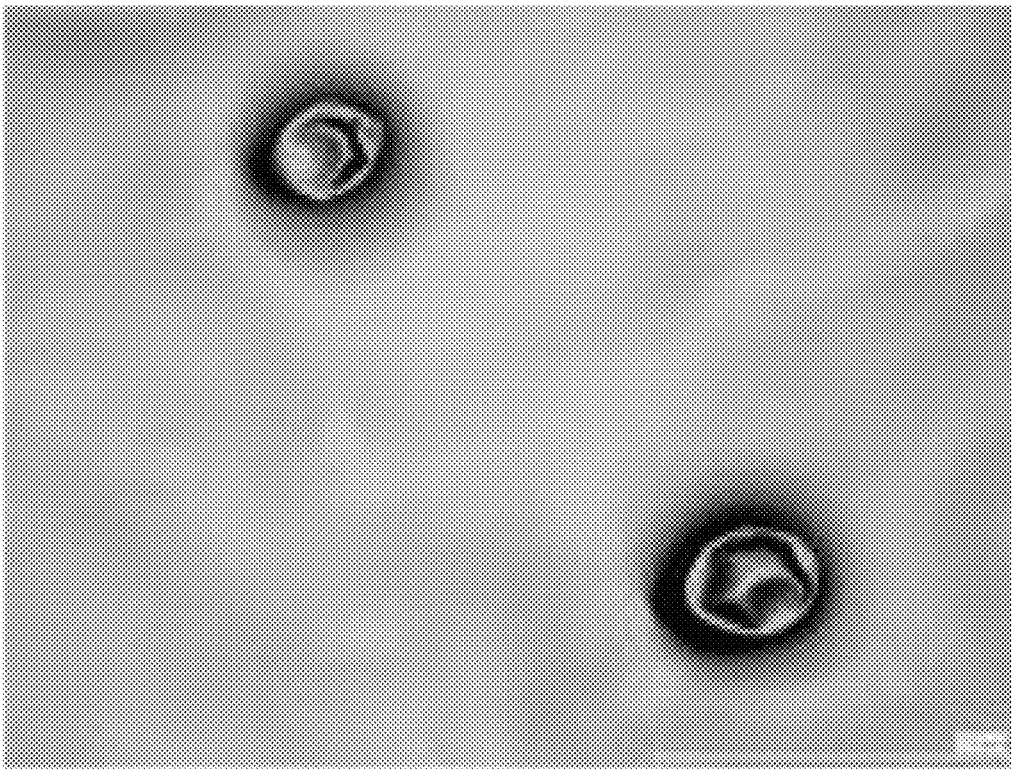
FIG. 1 is a laser microscope image (at a magnification of 50×) of two protrusions P (that is, protrusions P each having a depression at the central part) in the Fe-based amorphous alloy ribbon in Comparative Example 1, in the case of observing the protrusions from the vertical direction to the free solidified surface.

In the present disclosure, the term "step" includes not only an independent step, but also a case which cannot be clearly distinguished from other step, as long as the predetermined purpose of the step is achieved.

In the present disclosure, the "nanocrystalline alloy" means an alloy including a nanocrystal phase (that is, a phase composed of nanocrystal particles). The "nanocrystalline alloy" may include a phase (for example, an amorphous phase) other than the nanocrystal phase.

In the present disclosure, the "Fe-based" means that the main component (that is, the component having the largest content by mass) is Fe.

[Method for Producing Fe-Based Nanocrystalline Alloy Ribbon]

The method for producing an Fe-based nanocrystalline alloy ribbon according to the present disclosure includes:

a step of supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm; and a step of heat-treating the Fe-based amorphous alloy ribbon, thereby obtaining an Fe-based nanocrystalline alloy ribbon;

wherein the outer peripheral part of the chill roll is composed of a Cu alloy, and the thermal conductivity of the outer peripheral part is from 70 W/(m·K) to 225 W/(m·K).

The method for producing an Fe-based nanocrystalline alloy ribbon according to the present disclosure may include other step, as necessary.

In the present disclosure, the free solidified surface of an Fe-based amorphous alloy ribbon means a main surface that is not in contact with the chill roll and is exposed to the atmosphere in the stage of producing an Fe-based amorphous alloy ribbon, among the two main surfaces of the Fe-based amorphous alloy ribbon. The meaning of the free solidified surface of an Fe-based nanocrystalline alloy ribbon, which is obtained by heat-treating an Fe-based amorphous alloy ribbon, is also the same.

In the present disclosure, the roll contact surface of an Fe-based amorphous alloy ribbon means a main surface that is in contact with the chill roll in the stage of producing an Fe-based amorphous alloy ribbon, among the two main surfaces of the Fe-based amorphous alloy ribbon. The meaning of the roll contact surface of an Fe-based nanocrystalline alloy ribbon, which is obtained by heat-treating an Fe-based amorphous alloy ribbon, is also the same.

The fact that the alloy ribbon has a free solidified surface and a roll contact surface means that the alloy ribbon is an alloy ribbon obtained by a single roll method.

The present inventors have made investigations and, as a result, it was found that, in the case of obtaining an Fe-based nanocrystalline alloy ribbon by supplying a molten Fe-based alloy onto a rotating chill roll, and rapidly solidifying the molten Fe-based alloy that has been supplied, thereby obtaining an Fe-based amorphous alloy ribbon having a free solidified surface and a roll contact surface (hereinafter, the above operation is also referred to as "casting"), and then heat-treating the obtained Fe-based amorphous alloy ribbon, thereby obtaining an Fe-based nanocrystalline alloy ribbon, and especially, in a case in which the thickness of the Fe-based amorphous alloy ribbon is 15 μm or less and, moreover, the outer peripheral part of the chill roll is composed of a Cu alloy, and the thermal conductivity of this outer peripheral part exceeds 225 W/(m·K), protrusions are likely to occur on the free solidified surface of the Fe-based nanocrystalline alloy ribbon.

The reason for this is not clear, but is guessed as follows.

Casting of the Fe-based amorphous alloy ribbon described above is generally performed while polishing the outer peripheral surface (that is, the surface of the outer peripheral part) of the chill roll. This polishing of the outer peripheral surface is conducted at a time period from the time at which the Fe-based amorphous alloy ribbon that has been casted is peeled off from the above outer peripheral surface to the time at which the next molten Fe-based alloy is supplied to this outer peripheral surface. Here, in a case in which the outer peripheral part of the chill roll is composed of a Cu alloy and, moreover, the thermal conductivity of the outer peripheral part exceeds 225 W/(m·K), there is a tendency that the Vickers hardness of the outer peripheral part is low. As a result, when polishing the outer peripheral surface of the chill roll, it is thought that deep abrasion is formed at the outer peripheral part, so that coarse polishing powder is produced, and the polishing powder thus produced is likely to adhere to the outer peripheral surface. It is thought that, in a case in which a molted Fe-based alloy is supplied onto the outer peripheral surface having the polishing powder adhered thereon, air is easily caught in the molten Fe-based alloy thus supplied and, as a result, locally, a part is produced, where the cooling speed is insufficient and crystallization causes easily, and this part becomes a protrusion. It is thought that, in a case in which the thickness of the Fe-based amorphous alloy ribbon to be casted is reduced (specifically, 15 μm or less), the ribbon is further susceptible to the influence of the polishing powder, and thus, protrusions occur more easily. It is thought that the protrusions that have occurred are maintained also in the free solidified surface of the Fe-based nanocrystalline alloy ribbon, which is obtained by heat-treating the Fe-based amorphous alloy ribbon.

In connection with the problems described above, according to the method for producing an Fe-based nanocrystalline alloy ribbon of the present disclosure, in spite of casting an Fe-based amorphous alloy ribbon having a thickness of 15 μm or less, the occurrence of protrusions in the free solidified surface can be suppressed.

The thermal conductivity of the outer peripheral part (that is, the outer peripheral part composed of a Cu alloy) of the chill roll being 225 W/(m·K) or less contributes to the effect of suppressing the occurrence of protrusions in the free solidified surface. In detail, it is thought that, when the thermal conductivity of the outer peripheral part is 225 W/(m·K) or less, the Vickers hardness of the outer peripheral part is high (that is, the outer peripheral part is hard), the production of coarse polishing powder described above is suppressed and, as a result, the occurrence of protrusions is suppressed.

Hereinafter, each of the steps in the method for producing an Fe-based nanocrystalline alloy ribbon according to the present disclosure is described.

<Step of Obtaining Fe-Based Amorphous Alloy Ribbon>

The step of obtaining an Fe-based amorphous alloy ribbon is a step of obtaining an Fe-based amorphous alloy ribbon having a free solidified surface and a roll contact surface, and having a width of from 5 mm to 65 mm and a thickness of from 10 μm to 15 μm, by supplying a molten Fe-based alloy onto a rotating chill roll, and rapidly solidifying the molten Fe-based alloy that has been supplied onto the chill roll.

(Preferable Alloy Composition of Molten Fe-Based Alloy)

A preferable alloy composition of the molten Fe-based alloy is an alloy composition represented by the following Composition Formula (A), in view of easily forming a nanocrystal phase in the alloy structure through heat treatment.

Each of the steps in the method for producing an Fe-based nanocrystalline alloy ribbon according to the present disclosure does not affect the alloy composition of the alloy.

Accordingly, the alloy composition of the molten Fe-based alloy is maintained as it is also in the Fe-based amorphous alloy ribbon and the Fe-based nanocrystalline alloy ribbon, which are produced by using the molten Fe-based alloy.

Namely, the alloy composition represented by the following Composition Formula (A) is a preferable chemical composition for the molten Fe-based alloy, and moreover, a preferable chemical composition for the Fe-based amorphous alloy ribbon, and furthermore, a preferable chemical composition for the Fe-based nanocrystalline alloy ribbon.

$$Fe_{100-a-b-c-d-e}Cu_aSi_bB_cNb_dC_e \qquad \text{Composition Formula (A)}$$

In Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

Hereinafter, the alloy composition represented by Composition Formula (A) is explained.

Hereinafter, the atomic percent that indicates the content of the relevant element means an atomic percent of a relevant element when a total of Fe, Cu, Si, B, Nb, and C is taken as 100 atom %.

Fe is an element responsible for soft magnetic properties.

From the viewpoint of obtaining a high saturation magnetic flux density Bs, the content (atomic percent) of Fe (that is, "100-a-b-c-d-e" in Composition Formula (A)) is preferably 72.00 atom % or more, and more preferably 74.00 atom % or more.

Cu is an element which becomes the nucleus of a nanocrystal particle, when an Fe-based amorphous alloy ribbon is heat-treated to obtain an Fe-based nanocrystalline alloy ribbon. By this heat treatment, nanocrystal particles are precipitated in the alloy structure.

From the viewpoint of such an effect, the content of Cu (that is, "a" in Composition Formula (A)) is 0.30 atom % or more, preferably 0.80 atom % or more, and more preferably 0.90 atom % or more.

Meanwhile, when the content of Cu exceeds 2.00 atom %, there is a high possibility that nanocrystal nuclei exist in the Fe-based amorphous alloy ribbon before heat treatment, and therefore, heat treatment may cause crystals to grow starting from the nanocrystal nuclei, resulting in coarse crystal formation and deterioration in magnetic properties. Accordingly, the content of Cu is 2.00 atom % or less, preferably 1.50 atom % or less, and more preferably 1.30 atom % or less.

Si is an element which improves the soft magnetic properties by reducing the magnetocrystalline anisotropy of Fe, and which is effective in amorphous-forming ability together with B (boron).

When the content of Si is 13.00 atom % or more, a high amorphous-forming ability is obtained in the preparation of an Fe-based amorphous alloy ribbon. Further, in the nanocrystalline alloy ribbon obtained by heat treatment, a low saturation magnetostriction can be obtained. Accordingly, the content of Si (that is, "b" in Composition Formula (A)) is 13.00 atom % or more, preferably 13.40 atom % or more, and more preferably 13.50 atom % or more.

Meanwhile, when the content of Si exceeds 16.00 atom %, the viscosity of the molten alloy lowers, and therefore, when discharging a molten alloy onto an outer peripheral surface of a chill roll and rapidly solidifying the molten alloy to obtain an Fe-based amorphous alloy ribbon, the smoothness of the free solidified surface of the Fe-based amorphous alloy ribbon may be deteriorated. Accordingly, the content of Si is 16.00 atom % or less, and preferably 15.5 atom % or less.

As described above, B (boron) is an element which is effective in amorphous-forming ability together with Si. Further, B is an element that determines the volume fraction of the amorphous phase, which is a phase that does not crystallize, when a nanocrystal phase (that is, a phase consisting of nanocrystal particles) is formed in the alloy structure through heat treatment. That is, B is an element that determines the volume ratio of the nanocrystal phase to the amorphous phase after heat treatment.

The magnetostriction of the nanocrystal phase is negative, whereas the magnetostriction of the amorphous phase is positive, and the magnetostriction of the entire alloy is determined from the ratio of the two phases. When the content of B is high, the volume fraction of the amorphous phase becomes larger as compared with the nanocrystal phase after heat treatment, and the saturation magnetostriction becomes great. It is said that the saturation magnetostriction is preferably $5\times10^{-6}$ or less. From the viewpoint of obtaining equal to or less than $5\times10^{-6}$ of the saturation magnetostriction, the content of B (that is, "c" in Composition Formula (A)) is 11.00 atom % or less, and preferably 9.00 atom % or less. In a case in which the saturation magnetostriction is small, even if a mechanical stress is applied to the magnetic core when storing a magnetic core, that has been prepared, in a box or the like, or when winding a winding wire on a magnetic core to form a coil, deterioration in magnetic properties is suppressed.

On the other hand, when the content of B is low, it becomes hard to stably obtain an amorphous phase, in preparing an alloy ribbon by quenching a molten alloy. From the viewpoint of stably obtaining an amorphous phase, the content of B is 6.00 atom % or more, and preferably 6.50 atom % or more.

Nb is an element effective in evenly distributing the nanocrystal particles, which are precipitated after heat treatment, in the alloy structure, and moreover, suppressing the formation of coarse crystal particles, to let fine nanocrystal particles precipitate.

From the viewpoint of such an effect, the content of Nb (that is, "d" in Composition Formula (A)) is 2.00 atom % or more, preferably 2.40 atom % or more, more preferably 2.50 atom % or more, and still more preferably 2.80 atom % or more.

On the other hand, since Nb does not contribute to the magnetic properties, the content of Nb is preferably 4.00 atom % or less, more preferably 3.50 atom % or less, and still more preferably 3.20 atom % or less.

C (carbon) is effective in stabilizing the viscosity of the molten Fe-based alloy. From the viewpoint of such an effect, the content of C (that is, "e" in Composition Formula (A)) is 0.04 atom % or more, preferably 0.05 atom % or more, more preferably 0.10 atom % or more, and still more preferably 0.12 atom % or more.

On the other hand, from the viewpoint of suppressing embrittlement of the alloy ribbon, the content of C is preferably 0.40 atom % or less, more preferably 0.35 atom % or less, and still more preferably 0.30 atom % or less.

The molten Fe-based alloy having the alloy composition represented by Composition Formula (A) may have at least one kind of impurity element in addition to this alloy composition (the same applies to the Fe-based amorphous alloy ribbon having the alloy composition represented by Composition Formula (A) and the Fe-based nanocrystalline alloy ribbon having the alloy composition represented by Composition Formula (A)).

Here, the term "impurity element" means an element other than the respective elements in the alloy composition represented by Composition Formula (A).

A total content of impurity elements is preferably 0.20 atom % or less and more preferably 0.10 atom % or less, when the entire alloy composition represented by Composition Formula (A) (that is, a total of Fe, Cu, Si, B, Nb, and C) is taken as 100 atom %.

(Chill Roll)

In the step of obtaining an Fe-based amorphous alloy ribbon, by supplying a molten Fe-based alloy onto a chill roll and quenching the molten Fe-based alloy that has been supplied onto the chill roll, the above Fe-based amorphous alloy ribbon is obtained.

The outer peripheral part (that is, a part including the outer peripheral surface) of the chill roll is composed of a Cu alloy.

The thermal conductivity of the outer peripheral part composed of a Cu alloy is from 70 W/(m·K) to 225 W/(m·K).

When the thermal conductivity of the outer peripheral part composed of a Cu alloy is 225 W/(m·K) or less, the occurrence of protrusions in the free solidified surface of the finally obtained Fe-based nanocrystalline alloy ribbon is suppressed.

From the viewpoint of further suppressing the occurrence of protrusions, the thermal conductivity of the outer peripheral part is preferably 220 W/(m·K) or less, more preferably 200 W/(m·K) or less, still more preferably 170 W/(m·K) or less, still more preferably 150 W/(m·K) or less, and still more preferably 130 W/(m·K) or less.

On the other hand, from the viewpoint of the performance of quenching the molten Fe-based alloy that has been supplied onto the chill roll, the thermal conductivity of the outer peripheral part is 70 W/(m·K) or more. From the viewpoint of further enhancing the above performance, the thermal conductivity of the outer peripheral part is preferably 90 W/(m·K) or more, and more preferably 110 W/(m·K) or more.

The thermal conductivity of the outer peripheral part can be controlled by the kind and amount of the contained metal element other than Cu, in the Cu alloy that constitutes the outer peripheral part.

For example, in a Cu—Be alloy, the thermal conductivity can be controlled by the content of Be. An example of a Cu alloy having a thermal conductivity of from 70 W/(m·K) to 225 W/(m·K) is a Cu—Be alloy containing Be in an amount of from 1.6% by mass to 2.2% by mass with respect to the entire Cu—Be alloy.

In the Cu—Be alloy described above, the residue obtained by excluding Be is Cu and impurities. The impurity in the Cu—Be alloy is at least one kind among the elements other than Cu or Be. Examples of the impurities in the Cu—Be alloy include Ni, Co, and the like. The total content of the impurities is, for example, 1.0% by mass or less.

Further, examples of the Cu alloy that constitutes the outer peripheral part also include a Cu—Ni alloy, a Cu—Ni—Be alloy, and the like. These Cu alloys may also include impurities. Examples of the impurities include Si, Cr, Ag, Zr, and the like.

The Vickers hardness of the outer peripheral part of the chill roll is preferably 250 HV or more. Thereby, the occurrence of protrusions in the free solidified surface is further suppressed.

From the viewpoint of further suppressing the occurrence of protrusions in the free solidified surface, the Vickers hardness of the outer peripheral part of the chill roll is more preferably 260 HV or more, and still more preferably 300 HV or more.

It is not necessary to particularly restrict the upper limit of the Vickers hardness of the outer peripheral part of the chill roll.

For example, the Vickers hardness of the outer peripheral part of the chill roll can be made 400 HV or less. Thereby, polishing of the outer peripheral part of the chill roll becomes easier during casting (that is, during the production of the Fe-based amorphous alloy ribbon), the removal property with respect to the welded matter that has been adhered to the outer peripheral surface (that is, the outer surface of the outer peripheral part) of the chill roll is further improved, and crystallization of the Fe-based amorphous alloy ribbon caused by the welded matter is further suppressed.

In the present disclosure, the Vickers hardness means a value measured with a test load of 20 kgf.

It is preferable that the chill roll is provided therein with a structure that cools the outer peripheral part. Thereby, the temperature elevation of the outer peripheral surface caused by the contact with the molten Fe-based alloy is further suppressed, and the cooling power in the outer peripheral surface is maintained further effectively.

The structure that cools the outer peripheral part is preferably a structure in which temperature-controlled water is circulated while bringing the water in contact with the outer peripheral part at the side of the chill roll rotary shaft (that is, the inner surface of the outer peripheral part).

In this case, it is preferable from a structural point of view that, in the chill roll, a different alloy is used as the material for the part that locates on the side of the chill roll rotary shaft seen from the outer peripheral part. Regarding the different alloy, it is not necessary to particularly take the thermal conductivity into consideration. Examples of the different alloy include a stainless steel, a cast iron, and the like.

The thickness of the outer peripheral part of the chill roll is preferably from 15 mm to 40 mm, from the viewpoint of ensuring the cooling power with respect to the molten Fe-based alloy, and from the viewpoint of ease of maintaining the surface state of the outer peripheral surface of the chill roll.

The thickness of the outer peripheral part is more preferably 17 mm or more, and still more preferably 20 mm or more.

Further, the thickness of the outer peripheral part is more preferably 30 mm or less.

The diameter of the chill roll is preferably 300 mm or more, and more preferably 400 mm or more, from the viewpoint of maintaining the main body of the chill roll.

Further, the diameter of the chill roll is preferably 1,000 mm or less, and more preferably 900 mm or less.

Moreover, the width of the chill roll is preferably 2.5 times or more as long as the maximum width of the Fe-based amorphous alloy ribbon to be produced, from the viewpoint of further stably obtaining the cooling power with respect to the molten Fe-based alloy. The width of the chill roll is more preferably 3.0 times or more as long as the maximum width of the Fe-based amorphous alloy ribbon.

On the other hand, from the viewpoint of maintaining the surface state of the outer peripheral surface of the chill roll, the width of the chill roll is preferably 10.0 times or less as long as the maximum width of the Fe-based amorphous alloy ribbon.

From the viewpoints of further enhancing the cooling speed of the molten Fe-based alloy and further stably producing the Fe-based amorphous alloy ribbon, the circumferential speed of the outer periphery of the rotating chill roll is preferably from 20 m/sec to 35 m/sec. The circumferential speed of the outer periphery of the rotating chill roll is more preferably from 25 m/sec to 35 m/sec, and still more preferably from 27 m/sec to 30 m/sec.

(Width and Thickness of Fe-Based Amorphous Alloy Ribbon)

In the step of obtaining an Fe-based amorphous alloy ribbon, an Fe-based amorphous alloy ribbon having a width of from 5 mm to 65 mm, and a thickness of from 10 μm to 15 μm is obtained.

The width and thickness of the Fe-based amorphous alloy ribbon do not change even when the heat treatment described below is performed. Accordingly, the width of the Fe-based nancrystalline alloy ribbon obtained by heat-treating the Fe-based amorphous alloy ribbon is also from 5 mm to 65 mm, and the thickness of the Fe-based nanocrystalline alloy ribbon is also from 10 μm to 15 μm.

When the thickness of the Fe-based amorphous alloy ribbon is 15 μm or less, eddy current loss is suppressed in a magnetic core which is produced using the Fe-based amorphous alloy ribbon.

Further, as described above, in a case in which the thickness of the Fe-based amorphous alloy ribbon is 15 μm or less, protrusions tend to occur easily on the free solidified surface. However, according to the method for producing an Fe-based nanocrystalline alloy ribbon of the present disclosure, although the thickness is 15 μm or less, an Fe-based amorphous alloy ribbon and an Fe-based nanocrystalline alloy ribbon, in which the occurrence of protrusions in the free solidified surface is suppressed, are obtained.

The thickness of the Fe-based amorphous alloy ribbon is preferably 14.7 μm or less, more preferably 14.5 μm or less, still more preferably 14 μm or less, and still more preferably 13.5 μm or less.

Meanwhile, the thickness of the Fe-based amorphous alloy ribbon is 10 μm or more. Thereby, a long Fe-based amorphous alloy ribbon and a long Fe-based nanocrystalline alloy ribbon are obtained stably. Further, a mechanical strength for suppressing breakage due to handling or the like in the post-step is ensured.

The thickness of the Fe-based amorphous alloy ribbon is preferably 11 μm or more.

Further, when the width of the Fe-based amorphous alloy ribbon is 65 mm or less, a long Fe-based amorphous alloy ribbon and a long Fe-based nanocrystalline alloy ribbon are obtained stably. The width of the Fe-based amorphous alloy ribbon is preferably 63 mm or less, more preferably 60 mm or less, and still more preferably 55 mm or less.

On the other hand, when the width of the Fe-based amorphous alloy ribbon is 5 mm or more, productivity (economic rationality) is ensured. The width of the Fe-based amorphous alloy ribbon is preferably 10 mm or more, and more preferably 15 mm or more.

In this step, the width of the Fe-based amorphous alloy ribbon may be adjusted to be from 5 mm to 65 mm, by slitting the Fe-based amorphous alloy ribbon.

Further, by slitting, plural Fe-based amorphous alloy ribbons each having a width of from 5 mm to 65 mm may be obtained.

Each of the width and the thickness of the Fe-based amorphous alloy ribbon is maintained also in the Fe-based nanocrystalline alloy ribbon, which is obtained by heat-treating the Fe-based amorphous alloy ribbon.

Accordingly, preferable ranges of the width and the thickness of the Fe-based nanocrystalline alloy ribbon are substantially the same as the preferable ranges of the width and the thickness of the Fe-based amorphous alloy ribbon, respectively.

(Warpage of Fe-Based Amorphous Alloy Ribbon)

It is preferable that the warpage of the Fe-based amorphous alloy ribbon is 0.30 mm or less per 10 mm of width of the Fe-based amorphous alloy ribbon.

Thereby, in the case of forming an insulation layer on the Fe-based amorphous alloy ribbon, uniformity of the thickness of the insulation layer (in detail, uniformity in the width direction of the Fe-based amorphous alloy ribbon) is further improved.

As a result, falling-off of the insulation layer from the Fe-based amorphous alloy ribbon having the insulation layer formed thereon (or the Fe-based nanocrystalline alloy ribbon obtained by heat treatment) is further suppressed.

Accordingly, in the magnetic core described below, deterioration in insulation property between the Fe-based nanocrystalline alloy ribbon that is adjacent to itself (that is, deterioration in insulation property caused by the falling-off of the insulation layer) is suppressed effectively.

The warpage of the Fe-based amorphous alloy ribbon per 10 mm of width of the Fe-based amorphous alloy ribbon is more preferably 0.25 mm or less, still more preferably 0.20 mm or less, and still more preferably 0.10 mm or less.

That the thermal conductivity of the outer peripheral part of the chill roll is from 70 W/(m·K) to 225 W/(m·K) also contributes to the reduction in the warpage of the Fe-based amorphous alloy ribbon.

In a case in which the Vickers hardness of the outer peripheral part of the chill roll is 250 HV or more, the warpage of the Fe-based amorphous alloy ribbon is further reduced.

The warpage of the Fe-based amorphous alloy ribbon is measured as follows. The Fe-based amorphous alloy ribbon is placed on a surface plate so that the convex side of the warp becomes the upper surface, and the warpage is measured using a device having a laser light emitting section and a laser light receiving section.

As the device, for example, a LB-300 (trade name) manufactured by KEYENCE CORPORATION is used.

The warpage of the Fe-based amorphous alloy ribbon is also maintained in the Fe-based nanocrystalline alloy ribbon obtained by heat-treating the Fe-based amorphous alloy ribbon.

Accordingly, a preferable range of the warpage of the Fe-based nanocrystalline alloy ribbon is substantially the same as the preferable range of the warpage of the Fe-based amorphous alloy ribbon.

The method of measuring the warpage of the Fe-based nanocrystalline alloy ribbon is substantially the same as the method of measuring the warpage of the Fe-based amorphous alloy ribbon.

<Step of Obtaining Fe-Based Nanocrystalline Alloy Ribbon>

In the step of obtaining an Fe-based nanocrystalline alloy ribbon, the Fe-based amorphous alloy ribbon described above is heat-treated to obtain an Fe-based nanocrystalline alloy ribbon.

By the heat treatment, at least a part of the alloy structure in the Fe-based amorphous alloy ribbon is nanocrystallized (that is, nanocrystal particles are formed) and, as a result, an Fe-based nanocrystalline alloy ribbon is obtained.

In the method for producing an Fe-based nanocrystalline alloy ribbon according to the present disclosure, the Fe-based amorphous alloy ribbon obtained in the step of obtaining an Fe-based amorphous alloy ribbon may be heat-treated as it is, or the Fe-based amorphous alloy ribbon obtained in the step of obtaining an Fe-based amorphous alloy ribbon may be layered or wound, followed by heat treating the obtained layered body or wound body.

In the mode of heat-treating the wound body obtained by winding the Fe-based amorphous alloy ribbon, the method of producing a magnetic core according to the present disclosure, which is described below, is involved.

The maximum temperature in the heat treatment is preferably from 500° C. to 700° C., and more preferably from 550° C. to 600° C.

In the heat treatment, the retention time at the maximum temperature is preferably from 0.3 hours to 5 hours, more preferably from 0.5 hours to 3 hours, and still more preferably from 1 hour to 2 hours.

The atmosphere in the heat treatment may be a non-oxidizing atmosphere such as nitrogen, or may be an air atmosphere. From the viewpoint of quality stabilization, a non-oxidizing atmosphere is preferable.

The heat treatment is performed by, for example, using a heat treatment furnace.

The heat treatment may be conducted in a magnetic field.

[Method for Producing Magnetic Core]

The method for producing a magnetic core according to the present disclosure is a method for producing a magnetic core including a wound body C, in which the Fe-based nanocrystalline alloy ribbon is wound via an insulation layer;

wherein the method includes:

a step of supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm;

a step of forming the insulation layer on the free solidified surface of the Fe-based amorphous alloy ribbon:

a step of winding the Fe-based amorphous alloy ribbon having the insulation layer formed thereon, thereby obtaining a wound body A in which the Fe-based amorphous alloy ribbon is wound via the insulation layer; and a step of heat-treating the wound body A, thereby obtaining the wound body C (that is, the wound body C in which the Fe-based nanocrystalline alloy ribbon is wound via the insulation layer);

wherein the outer peripheral part of the chill roll is composed of a Cu alloy, and the thermal conductivity of the outer peripheral part is from 70 W/(m·K) to 225 W/(m·K).

The method for producing a magnetic core according to the present disclosure may include other step, as necessary.

The step of forming an insulating layer, the step of obtaining a wound body A, and the step of obtaining a wound body C in the method for producing a magnetic core according to the present disclosure are all involved in the concept of the "step of obtaining an Fe-based nanocrystalline alloy ribbon" in the above-described method for producing an Fe-based nanocrystalline alloy ribbon according to the present disclosure.

Except this point, the method for producing a magnetic core according to the present disclosure is substantially the same as the above-described method for producing an Fe-based nanocrystalline alloy ribbon according to the present disclosure.

The "step of obtaining an Fe-based amorphous alloy ribbon" in the method for producing a magnetic core according to the present disclosure is substantially the same as the "step of obtaining an Fe-based amorphous alloy ribbon" in the above-described method for producing an Fe-based nanocrystalline alloy ribbon according to the present disclosure. Accordingly, also in the "step of obtaining an Fe-based amorphous alloy ribbon" in the method for producing a magnetic core according to the present disclosure, an Fe-based amorphous alloy ribbon, in which the occurrence of protrusions in the free solidified surface is suppressed, is obtained.

In the method for producing a magnetic core according to the present disclosure, a wound body A, in which the Fe-based amorphous alloy ribbon is wound via the insulation layer, is subjected to heat treatment. According to this heat treatment, the Fe-based amorphous alloy ribbon in the wound body A is converted into an Fe-based nanocrystalline alloy ribbon and, as a result, a magnetic core including a wound body C, in which the Fe-based nanocrystalline alloy ribbon is wound via the insulation layer, is obtained.

As described above, in the Fe-based amorphous alloy ribbon in the wound body A, the occurrence of protrusions in the free solidified surface is suppressed. Therefore, in the wound body C, deterioration in insulation property between the Fe-based nanocrystalline alloy ribbon that is adjacent to itself via the insulation layer is suppressed.

As described above, in the magnetic core produced by the method for producing a magnetic core according to the present disclosure, the insulation properties between the Fe-based nanocrystalline alloy ribbon that is adjacent to itself via the insulation layer is excellent.

Accordingly, in the magnetic core produced by the method for producing a magnetic core according to the present disclosure, eddy current loss is reduced.

In general, the loss of a magnetic core is determined by hysteresis loss and eddy current loss.

The eddy current loss has frequency dependency and the tendency that the eddy current loss gets more significant as the frequency to be applied gets higher is remarkable.

From the viewpoint described above, the method for producing a magnetic core according to the present disclosure is particularly suitable as a method for producing a magnetic core to be used in a high frequency condition (particularly, a high frequency condition in the order of MHz or higher).

From the viewpoint of further suppressing the eddy current loss, it is preferable that the magnetic core produced by the method for producing a magnetic core according to the present disclosure satisfies that the insulation rate RI described below is 80% or higher. A more preferable range of the insulation rate RI is substantially the same as the more preferable range of the insulation rate RI in the magnetic core according to one example of the present disclosure, which is described below.

Hereinafter, the steps other than the step of obtaining an Fe-based amorphous alloy ribbon, in the method for producing a magnetic core according to the present disclosure, are described.

<Step of Forming Insulation Layer>

In the step of forming an insulation layer in the method for producing a magnetic core according to the present disclosure, an insulation layer is formed on the free solidified surface of the Fe-based amorphous alloy ribbon.

It is preferable that the insulation layer includes a metal oxide such as a heat-treated silica (silica oxide), alumina (aluminum oxide), magnesia (magnesium oxide), or the like.

In this case, the metal oxide included in the insulation layer may be only one kind or may be two or more kinds.

In a case in which the insulation layer includes a metal oxide, the influence of heat treatment against the insulation layer in the step of obtaining a wound body C is further reduced.

For example, the maximum temperature of a heat treatment at a maximum temperature of from 550° C. to 600° C. exceeds the heat resistant temperature of organic matters such as polymers. Also in a case of performing heat treatment at this maximum temperature, when the insulation layer includes a metal oxide, the influence of the heat treatment against the insulation layer is reduced, and the insulation property of the insulation layer is obtained effectively.

The thickness of the insulation layer is preferably from 1.5 μm to 2.5 μm.

The insulation layer may be provided on both of the free solidified surface and the roll contact surface of the Fe-based amorphous alloy ribbon. However, it is preferable that the insulation layer is provided on the free solidified surface of the Fe-based amorphous alloy ribbon, but is not provided on the roll contact surface. Thus, contact of the insulation layer with itself is prevented in the step of obtaining a wound body and in the subsequent steps and, as a result, falling-off of the insulation layer caused by the contact of the insulation layer with itself is further suppressed.

For example, the insulation layer can be formed as follows.

A suspension is prepared by suspending a powdery metal oxide (hereinafter, also referred to as "metal oxide powder") in an organic solvent such as an alcohol. An Fe-based amorphous alloy ribbon is immersed in the obtained suspension for a certain time, thereby letting the suspension adhere to the Fe-based amorphous alloy ribbon. Subsequently, the suspension adhering to the Fe-based amorphous alloy ribbon is dried, so that an insulation layer can be formed on the free solidified surface and the roll contact surface of the Fe-based amorphous alloy ribbon.

The thickness of the insulation layer can be determined by controlling the content of the metal oxide powder in the suspension, the immersion time, and the like.

Here, in a case in which the suspension adhered to the roll contact surface is removed after taking out but before drying, an insulation layer can be formed only on the free solidified surface of the Fe-based amorphous alloy ribbon.

<Step of Obtaining Wound Body A>

In the step of obtaining a wound body A, the Fe-based amorphous alloy ribbon having the insulation layer formed thereon is wound, thereby obtaining a wound body A in which the Fe-based amorphous alloy ribbon is wound via the insulation layer.

Winding of the Fe-based amorphous alloy ribbon having the insulation layer formed thereon can be conducted according to a known method.

In this process, the wound body A may be temporarily fixed using, for example, a Cu wire having a diameter of about 0.5 mm, in order to maintain the form.

<Step of Obtaining Wound Body C>

In the step of obtaining a wound body C, by heat treating the wound body A, a wound body C (that is, a wound body C in which an Fe-based nanocrystalline alloy ribbon is wound via the insulation layer) is obtained.

In the step of obtaining a wound body C, the Fe-based amorphous alloy ribbon in the wound body A is heat-treated, whereby the Fe-based amorphous alloy ribbon is converted into an Fe-based nanocrystalline alloy ribbon. In this regard, the same holds for the "step of obtaining an Fe-based nanocrystalline alloy ribbon" in the method for producing an Fe-based nanocrystalline alloy ribbon according to the present disclosure, which is described above.

Preferable conditions for the heat treatment in the step of obtaining a wound body C are substantially the same as the preferable conditions for the heat treatment in the "step of obtaining an Fe-based nanocrystalline alloy ribbon" in the method for producing an Fe-based nanocrystalline alloy ribbon according to the present disclosure, which is described above.

As described above, the heat treatment may be conducted in a magnetic field.

With regard to the direction of the magnetic field, two directions, namely the circumferential direction of the magnetic core and the direction of the height of the magnetic core (the width of the alloy ribbon) are preferable.

The intensity of the applied magnetic field and/or the temperature region at which the magnetic field is applied can be optimized as appropriate in accordance with the use of the magnetic core.

Further, the above two directions of the magnetic field may be changed in turn.

[Fe-Based Nanocrystalline Alloy Ribbon and Magnetic Core]

The Fe-based nanocrystalline alloy ribbon according to one example of the present disclosure

- has a free solidified surface and a roll contact surface, in which
- a number of protrusions P each having a depression at a central part thereof is 1.2 or less per 100 $mm^2$ of area in the free solidified surface, and
- has a width of from 5 mm to 65 mm, and
- a thickness of from 10 μm to 15 μm.

Accordingly, in the Fe-based nanocrystalline alloy ribbon according to one example of the present disclosure, the occurrence of protrusions in the free solidified surface is suppressed.

The magnetic core according to one example of the present disclosure includes a wound body C1, in which the Fe-based nanocrystalline alloy ribbon according to one example of the present disclosure is wound via the insulation layer.

The magnetic core according to one example of the present disclosure has excellent insulation properties between the Fe-based nanocrystalline alloy ribbon that is adjacent to itself via the insulation layer.

As described above, with regard to an Fe-based nanocrystalline alloy ribbon having a thickness of 15 μm or less, protrusions easily occur in the free solidified surface, but among the protrusions, particularly, protrusions P each having a depression at the central part occur easily.

The present inventors have made investigations and, as a result, it has become clear that, by restricting the number of the protrusions P to 1.2 or less per 100 $mm^2$ of area in the free solidified surface of the Fe-based nanocrystalline alloy ribbon having a thickness of 15 μm or less, the insulation property between the Fe-based nanocrystalline alloy ribbons is remarkably improved in the magnetic core including the wound body C1 in which the Fe-based nanocrystalline alloy ribbon described above is wound via the insulation layer.

The Fe-based nanocrystalline alloy ribbon and magnetic core according to the present example have been made based on this knowledge.

In the present disclosure, the "wound body in which an Fe-based nanocrystalline alloy ribbon is wound via an insulation layer" (the wound body C1, or the wound body C) means a wound body which is in a state in which an Fe-based nanocrystalline alloy ribbon is wound via an insulation layer.

Accordingly, the "wound body in which an Fe-based nanocrystalline alloy ribbon is wound via an insulation layer" is not limited to a wound body obtained by winding an Fe-based nanocrystalline alloy ribbon having an insulation layer formed thereon.

For example, like the method for producing a magnetic core according to the present disclosure, which is described above, by heat-treating in the prescribed conditions, a wound body obtained by winding an Fe-based amorphous alloy ribbon having an insulation layer formed thereon, a wound body which is in a state in which an Fe-based nanocrystalline alloy ribbon is wound via an insulation layer is obtained. Such a wound body is also included in the concept of the "wound body in which an Fe-based nanocrystalline alloy ribbon is wound via an insulation layer".

There is no particular limitation as to the methods for producing an Fe-based nanocrystalline alloy ribbon and a magnetic core according to the present example.

For example, according to the method for producing an Fe-based nanocrystalline alloy ribbon of the present disclosure, which is described above, an Fe-based nanocrystalline alloy ribbon according to the present example can be suitably produced.

Particularly, according to the method for producing a magnetic core of the present disclosure, which is described above, a magnetic core according to the present example can be suitably produced. In this case, as the wound body C in the method for producing a magnetic core according to the present disclosure, a wound body C1 in the magnetic core according to the present example is obtained.

In the present example, the protrusion P having a depression at a central part thereof (hereinafter, may also referred to as, simply, "protrusion P") means a protrusion having a depression at the central part, in the case of observing the protrusion from the direction vertical to the free solidified surface.

In the present example, observation for determining the number of protrusions P per 100 $mm^2$ of area is conducted, using a stereo microscope at a magnification of 40×.

As described above, a number of protrusions P per 100 $mm^2$ of area of the free solidified surface is 1.2 or less. The number of protrusions P may be 0.

The number of protrusions P is preferably 1.0 or less, from the viewpoint of further improving the insulation property between the Fe-based nanocrystalline alloy ribbons in the magnetic core.

Preferable modes (for example, preferable modes of the alloy composition, the width, the thickness, the warpage, and the like) of the Fe-based nanocrystalline alloy ribbon according to the present example are substantially the same as the preferable modes of the Fe-based nanocrystalline alloy ribbon obtained by the method for producing an Fe-based nanocrystalline alloy ribbon according to the present disclosure.

Preferable modes of the magnetic core according to the present example are substantially the same as the preferable modes of the magnetic core obtained by the method for producing a magnetic core according to the present disclosure.

<Insulation Rate RI>

As described above, the magnetic core according to the present example has excellent insulation properties between the Fe-based nanocrystalline alloy ribbon itself. Thereby, the eddy current loss is reduced.

From the viewpoint of further reducing the eddy current loss, it is preferable that the magnetic core according to the present example has an insulation rate RI represented by the following Equation (1) of 80% or higher.

$$RI=Rr/(Ru\cdot Lr)\times 100(\%) \quad \text{Equation (1)}$$

In Equation (1),

Rr represents the direct current electric resistance value (Ω) between two ends, namely one end of an innermost periphery and another end of an outermost periphery in the Fe-based nanocrystalline alloy ribbon, Ru represents the direct current electric resistance value (Ω) per 1 m of length in the longitudinal direction of the Fe-based nanocrystalline alloy ribbon, and Lr represents the length (m) of the Fe-based nanocrystalline alloy ribbon.

Hereinafter, the insulation rate RI represented by Equation (1) is explained.

In the magnetic core according to the present example, in a case in which insulation is perfect between the Fe-based nanocrystalline alloy ribbons, the product of Ru by Lr (that is, "Ru·Lr") in Equation (1) becomes the same value as Rr in Equation (1). In this case, the insulation rate RI is 100%.

On the other hand, in a case in which a place where insulation is broken (that is, a short-circuited place) exists between the Fe-based nanocrystalline alloy ribbons, Rr gets smaller than "Ru·Lr". In this case, the insulation rate RI is lower than 100%.

Ru in Equation (1) is based on the diameter of the magnetic core according to the present example, and is determined by making an estimate for the position that is 1 m far from the outermost periphery end of this magnetic core and then measuring the direct current electric resistance value (Ω) between the outermost periphery end and the position that is 1 m far from the outermost periphery end.

From the viewpoint of further reducing the eddy current loss, the insulation rate RI in the magnetic core according to the present example is preferably 85% or higher, and more preferably 90% or higher.

Further, the insulation rate RI in the magnetic core according to the present example may be 100%. However, from the viewpoint of the production suitability (ease of production) of the magnetic core, the insulation rate RI is preferably lower than 100%.

EXAMPLES

Hereinafter, Examples of the present disclosure are described; however, the present disclosure is by no means limited to the following Examples.

Example 1

—Production (Casting) of Fe-Based Amorphous Alloy Ribbon—

A molten Fe-based alloy (9.1 kg) having an alloy composition represented by $Fe_{bal.}Cu_{0.98}Si_{14.99}B_{6.68}Nb_{2.89}C_{0.05}$ (atom %) was supplied onto a rotating chill roll, and the molten Fe-based alloy that had been supplied was rapidly solidified. In this way, an Fe-based amorphous alloy ribbon having a free solidified surface and a roll contact surface, and having a width of 25 mm and a thickness of 13.4 μm was obtained.

Here, the "bal." (balance) is a value that corresponds to "100-a-b-c-d-e" in the Composition Formula (A).

It was confirmed that the obtained Fe-based alloy ribbon is an Fe-based amorphous alloy ribbon, that is, the alloy structure is composed of an amorphous phase, by observing the cross section of the ribbon, using a scanning electron microscope (SEM).

The alloy composition of the Fe-based alloy does not change in all of the steps in the Example. Accordingly, the alloy compositions of the molten Fe-based alloy, the Fe-based amorphous alloy ribbon, and the Fe-based nanocrystalline alloy ribbon described below are the same.

Further, the size of the ribbon (the thickness, the width, and the length) does not change in all of the steps in the Example. Accordingly, the size (the thickness, the width, and the length) of the Fe-based nanocrystalline alloy ribbon described below is the same as the size (the thickness, the width, and the length) of the Fe-based amorphous alloy ribbon.

Hereinafter, the simple term "ribbon" means an Fe-based nanocrystalline alloy ribbon or an Fe-based amorphous alloy ribbon.

With regard to the rotational speed of the chill roll, the circumferential speed of the outer periphery was set to 28 m/s.

The following chill roll was used as the chill roll.

This chill roll is provided therein with a channel for circuiting cooling water, as a structure that cools the outer peripheral part.

—Chill Roll—

Diameter: 800 mm

Width: 150 mm

Thickness of the outer peripheral part: 20 mm

Material of the outer peripheral part: Cu—Be alloy (Be: 1.9% by mass, remainder: Cu and impurities)

Thermal conductivity of the outer peripheral part: 124 W/(m·K)

—Vickers Height Hardness of Outer Peripheral Part—

The Vickers hardness of the outer peripheral part was measured with a test load of 20 kgf, using a Vickers hardness tester.

The results are shown in Table 1.

—Measurement of Number of Protrusions P per 100 $mm^2$ of Area in Free Solidified Surface—

For evaluating the number of protrusions P in the free solidified surface of the obtained Fe-based amorphous alloy ribbon, 30 visual field (area 1154 $mm^2$) observation was conducted with respect to the free solidified surface, at a magnification of 40×, using a stereo microscope.

Based on the observation results, the number of protrusions P per 100 $mm^2$ of area was determined.

The results are shown in Table 1.

The number of protrusions P in the free solidified surface of the Fe-based amorphous alloy ribbon (that is, the ribbon before heat treatment) does not change in the subsequent steps.

Accordingly, the number of protrusions Pin the free solidified surface of the Fe-based nanocrystalline alloy ribbon (that is, the ribbon after heat treatment) described below is the same as the number of protrusions Pin the free solidified surface of the Fe-based amorphous alloy ribbon (that is, the ribbon before heat treatment).

—Warpage in Width Direction—

The warpage in the width direction of the Fe-based amorphous alloy ribbon was measured as follows.

From each of the end on the casting initiation side of the Fe-based amorphous alloy ribbon and the end on the casting finish side, one sheet of a sample having a length of 100 mm was collected.

Each of the samples was placed on a surface plate so that the convex side of the warp was the upper surface side, and in this state, the height of the top portion in the upper surface of the sample was measured. The height of the top portion was measured, using a LB-300 (trade name) manufactured by KEYENCE CORPORATION.

The maximum value of the height of the top portion in the two sheets of samples was 0.10 mm.

Since the width of the sample is 25 mm, it was determined that the warpage in the width direction of the Fe-based amorphous alloy ribbon was 0.04 mm per 10 mm of width (see, Table 1).

—Formation of Insulation Layer—

An insulation layer having a thickness of 2.1 μm was formed on the free solidified surface of the Fe-based amorphous alloy ribbon as follows.

Silica powder having an average particle diameter of 0.5 μm was suspended in isopropyl alcohol (IPA), to prepare a suspension.

The Fe-based amorphous alloy ribbon obtained as described above was passed through this suspension, and then, the suspension adhered to the roll contact surface of the Fe-based amorphous alloy ribbon was removed.

By drying the suspension adhered to the free solidified surface of the Fe-based amorphous alloy ribbon, an insulation layer having a thickness of 2.1 μm was obtained.

—Preparation of Wound Body A—

By winding the Fe-based amorphous alloy ribbon (length 264 m) having an insulation layer formed thereon, a wound body A (that is, a wound body A in which the Fe-based amorphous alloy ribbon is wound via the insulation layer) having an inner diameter of 60.5 mm and an outer diameter of 100.0 mm was obtained.

—Preparation of Wound Body C (Magnetic Core)—

By heat treating the wound body A in the conditions of a maximum retention temperature of 580° C. and a retention time of 2 hours, a wound body C (that is, a wound body C in which an Fe-based nanocrystalline alloy ribbon is wound via the insulation layer) was obtained, as a magnetic core.

It was confirmed that the Fe-based alloy ribbon in the wound body C is an Fe-based nanocrystalline alloy ribbon, that is, nanocrystal particles are formed in the alloy structure, by observing the cross section of the ribbon in the wound body C, using a scanning electron microscope (SEM).

—Measurement of Insulation Rate RI—

The insulation rate RI (that is, the insulation rate RI represented by Equation (1)) of the magnetic core obtained as described above was measured according to the method described above.

The results are shown in Table 1.

Examples 2 to 4, and Comparative Example 1

Operation substantially similar to that in Example 1 was conducted, except that the conditions (including the alloy composition of the molten Fe-based alloy) for producing an Fe-based amorphous alloy ribbon were changed as shown in Table 1.

However, with regard to Examples 3 and 4, further, the maximum retention temperature of the heat treatment with respect to the wound body A was changed to 550° C.

The results are shown in Table 1.

In Example 2, the following chill roll was used.

The chill roll in Example 2 is also provided therein with a channel for circuiting cooling water, as a structure that cools the outer peripheral part.

—Chill Roll in Example 2—

Diameter: 800 mm

Width: 150 mm

Thickness of the outer peripheral part: 20 mm

Material of the outer peripheral part: Cu—Be alloy (Be: 2.0% by mass, remainder: Cu and impurities)

Thermal conductivity of the outer peripheral part: 120 W/(m·K)

In Example 3, the following chill roll was used.

Thermal conductivity of the outer peripheral part: 212 W/(m·K)

In Comparative Example 1, the following chill roll was used.

The chill roll in Comparative Example 1 is also provided therein with a channel for circuiting cooling water, as a structure that cools the outer peripheral part.

—Chill Roll in Comparative Example 1—

Diameter: 800 mm

Width: 150 mm

Thickness of the outer peripheral part: 20 mm

Material of the outer peripheral part: Cu—Be alloy (Be: 0.3% by mass, remainder: Cu and impurities)

Thermal conductivity of the outer peripheral part: 240 W/(m·K)

TABLE 1

| | Molten Fe-Based Alloy | | Chill Roll | | | Ribbon | | | | | Magnetic Core |
|---|---|---|---|---|---|---|---|---|---|---|---|
| | Alloy Composition (atom %) | Used Amount (kg) | Outer Peripheral Part Thermal Conductivity (W/(m · K)) | Outer Peripheral Part Vickers Hardness (HV) | Circumferential Speed of Outer Periphery (m/s) | Length (m) | Width (mm) | Thickness (μm) | Number of Protrusions P per 100 $mm^2$ in Free Solidified Surface | Warpage in Width Direction per 10 m of Width (mm) | Insulation Rate RI (%) |
| Example 1 | $Fe_{bal.}Cu_{0.98}Si_{14.99}B_{6.68}Nb_{2.89}C_{0.05}$ | 9.1 | 124 | 386 | 28 | 264 | 25 | 13.4 | 0 | 0.04 | 93.1 |
| Example 2 | $Fe_{bal.}Cu_{1.06}Si_{15.43}B_{7.60}Nb_{3.11}C_{0.30}$ | 9.4 | 120 | 392 | 28 | 259 | 25 | 13.0 | 0.32 | 0.28 | 84.0 |
| Example 3 | $Fe_{bal.}Cu_{1.02}Si_{14.20}B_{8.43}Nb_{2.98}C_{0.12}$ | 9.4 | 168 | 265 | 27 | 267 | 53 | 14.5 | 0.93 | 0.22 | 88.6 |
| Example 4 | $Fe_{bal.}Cu_{1.00}Si_{13.50}B_{7.57}Nb_{2.44}C_{0.17}$ | 9.4 | 212 | 263 | 27 | 266 | 63 | 14.7 | 0.69 | 0.12 | 86.5 |
| Comparative Example 1 | $Fe_{bal.}Cu_{0.98}Si_{14.99}B_{6.68}Nb_{2.89}C_{0.05}$ | 12.1 | 240 | 230 | 28 | 245 | 25 | 13.7 | 77.99 | 1.00 | 31.0 |

The chill roll in Example 3 is also provided therein with a channel for circuiting cooling water, as a structure that cools the outer peripheral part.

—Chill Roll in Example 3—

Diameter: 450 mm

Width: 300 mm

Thickness of the outer peripheral part: 17 mm

Material of the outer peripheral part: Cu—Ni alloy (Cu: 90% by mass or more, remainder: impurities (including Ni, Si, and Cr))

Thermal conductivity of the outer peripheral part: 168 W/(m·K)

In Example 4, the following chill roll was used.

The chill roll in Example 4 is also provided therein with a channel for circuiting cooling water, as a structure that cools the outer peripheral part.

—Chill Roll in Example 4—

Diameter: 650 mm

Width: 300 mm

Thickness of the outer peripheral part: 17 mm

Material of the outer peripheral part: Cu—Ni—Be alloy (Cu: 90% by mass or more, Ni: 7% by mass, Be: 0.3% by mass, remainder: impurities (including Ag, Cr, and Zr))

As shown in Table 1, in Examples 1 to 4, where the thermal conductivity of the outer peripheral part of the chill roll is from 70 W/(m·K) to 225 W/(m·K), the number of the protrusions P per 100 $mm^2$ in the free solidified surface of the ribbon was decreased, and moreover, the insulation rate RI of the magnetic core was excellent.

In contrast, in Comparative Example 1, where the thermal conductivity of the outer peripheral part of the chill roll exceeds 225 W/(m·K), the number of the protrusions P per 100 $mm^2$ in the free solidified surface of the ribbon was significantly increased, and moreover, the insulation rate RI of the magnetic core was significantly deteriorated.

Figure 2:
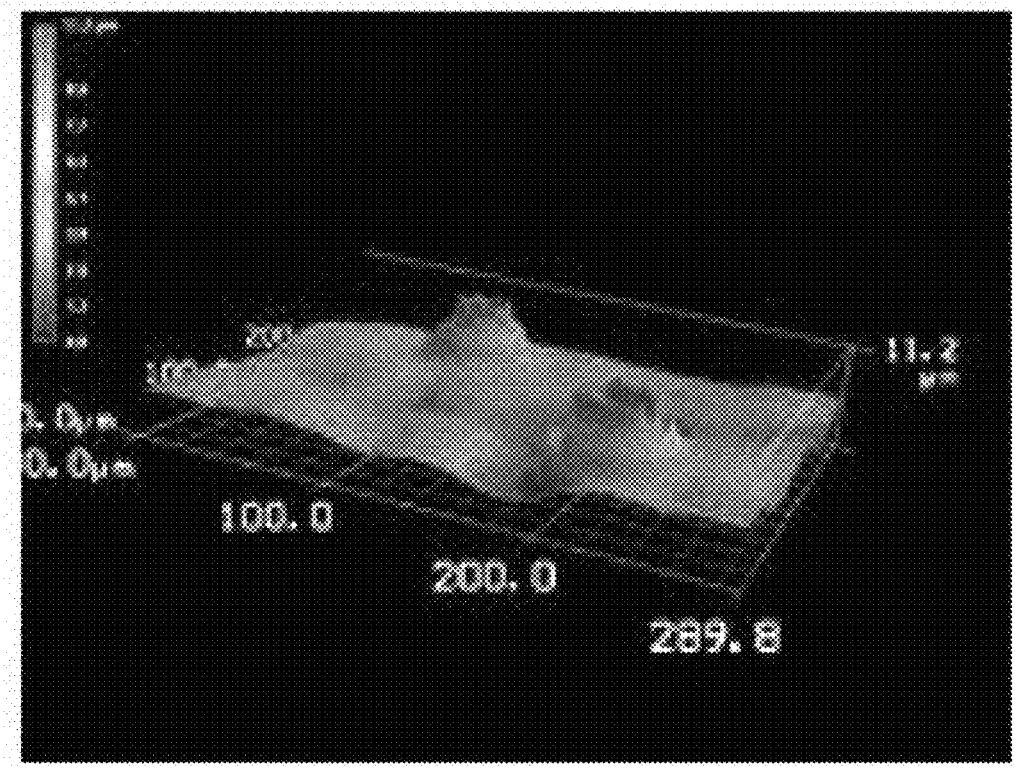
FIG. 2 is a 3D display diagram of FIG. 1.

FIG. 1 is a laser microscope image (at a magnification of 50×) of two protrusions P (that is, protrusions P each having a depression at the central part) in the Fe-based amorphous alloy ribbon in Comparative Example 1, in the case of observing the protrusions from the vertical direction to the free solidified surface. FIG. 2 is a 3D (Three Dimension) display diagram of FIG. 1. Here, as the laser microscope, a laser microscope "VK-8716" (trade name) manufactured by KEYENCE CORPORATION was used. Further, with regard to the analysis for obtaining a three dimensional image, an analysis software "VK Analyzer ver. 2.4.0.0" (trade name) manufactured by KEYENCE CORPORATION was used.

In Comparative Example 1, a large number of such protrusions P had occurred; however, in Examples 1 to 4, such protrusions P were decreased.

The disclosure of Japanese Patent Application No. 2018-180031 filed on Sep. 26, 2018 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

The invention claimed is:

1. A method for producing an Fe-based nanocrystalline alloy ribbon, the method comprising:

supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm; and heat-treating the Fe-based amorphous alloy ribbon, thereby obtaining an Fe-based nanocrystalline alloy ribbon, wherein an outer peripheral part of the chill roll is composed of a Cu alloy, and a thermal conductivity of the outer peripheral part is in a range of from 110 W/(m·K) to 225 W/(m·K), and a Vickers hardness of the outer peripheral part is in a range of from 250 HV to 400 HV, a number of protrusions P in the free solidified surface of the Fe-based nanocrystalline alloy ribbon, each having a depression at a central part thereof, is 1.2 or less per 100 $mm^2$ of area, warpage of the Fe-based amorphous alloy ribbon in the width direction is 0.30 mm or less per 10 mm of width, and the Cu alloy is a Cu—Be alloy containing Be in an amount of from 1.6% by mass to 2.2% by mass with respect to the entire Cu—Be alloy, wherein the molten Fe-based alloy has an alloy composition represented by the following Composition Formula (A):

$$Fe_{100-a-b-c-d-e}Cu_aSi_bB_cNb_dC_e \quad \text{Composition Formula (A):}$$

wherein, in Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

2. A method for producing a magnetic core comprising a wound body C in which an Fe-based nanocrystalline alloy ribbon is wound via an insulation layer, the method comprising:

supplying a molten Fe-based alloy onto a rotating chill roll, and rapidly solidifying the molten Fe-based alloy that has been supplied onto the chill roll, thereby obtaining an Fe-based amorphous alloy ribbon having a free solidified surface and a roll contact surface, and having a width of from 5 mm to 65 mm and a thickness of from 10 μm to 15 μm;

forming the insulation layer on the free solidified surface of the Fe-based amorphous alloy ribbon:

winding the Fe-based amorphous alloy ribbon having the insulation layer formed thereon, thereby obtaining a wound body A in which the Fe-based amorphous alloy ribbon is wound via the insulation layer; and heat-treating the wound body A, thereby obtaining the wound body C, wherein an outer peripheral part of the chill roll is composed of a Cu alloy, a thermal conductivity of the outer peripheral part is in a range of from 110 W/(m·K) to 225 W/(m·K), and a Vickers hardness of the outer peripheral part is in a range of from 250 HV to 400 HV, a number of protrusions P in the free solidified surface of the Fe-based nanocrystalline alloy ribbon, each having a depression at a central part thereof, is 1.2 or less per 100 $mm^2$ of area, warpage of the Fe-based amorphous alloy ribbon in the width direction is 0.30 mm or less per 10 mm of width, and the Cu alloy is a Cu—Be alloy containing Be in an amount of from 1.6% by mass to 2.2% by mass with respect to the entire Cu—Be alloy, wherein the molten Fe-based alloy has an alloy composition represented by the following Composition Formula (A):

$$Fe_{100-a-b-c-d-e}Cu_aSi_bB_cNb_dC_e \quad \text{Composition Formula (A):}$$

wherein, in Composition Formula (A), each of 100-a-b-c-d-e, a, b, c, d, and e represents an atomic percent of a relevant element when a total of Fe, Cu, Si, B, Nb, and C is 100 atom %, and a, b, c, d, and e satisfy $0.30 \le a \le 2.00$, $13.00 \le b \le 16.00$, $6.00 \le c \le 11.00$, $2.00 \le d \le 4.00$, and $0.04 \le e \le 0.40$, respectively.

* * * * *